US006990941B1

(12) United States Patent
Bender

(10) Patent No.: US 6,990,941 B1
(45) Date of Patent: Jan. 31, 2006

(54) INTAKE AIR PLENUM FOR INTERNAL COMBUSTION ENGINE

(75) Inventor: Lee Frederick Bender, Huntsville, AL (US)

(73) Assignee: C&L Performance, Inc., Huntsville, AL (US)

( * ) Notice: Subject to any disclaimer, the term of this patent is extended or adjusted under 35 U.S.C. 154(b) by 0 days.

(21) Appl. No.: 10/927,213

(22) Filed: Aug. 26, 2004

Related U.S. Application Data

(63) Continuation-in-part of application No. 29/198,261, filed on Jan. 27, 2004, now Pat. No. Des. 512,074.

(51) Int. Cl.
*F02M 35/10* (2006.01)

(52) U.S. Cl. ..... 123/184.21; 123/184.34

(58) Field of Classification Search ..... 123/184.21, 123/184.34, 184.35, 184.42, 184.43, 184.47, 123/184.48
See application file for complete search history.

(56) References Cited

U.S. PATENT DOCUMENTS

| | | | | | |
|---|---|---|---|---|---|
| 3,628,512 | A | * | 12/1971 | Wu | 123/184.34 |
| 3,783,843 | A | * | 1/1974 | McFarland, Jr. | 123/184.34 |
| 4,461,248 | A | * | 7/1984 | McFarland, Jr. | 123/184.35 |
| 4,592,329 | A | | 6/1986 | Yunick | |
| 4,805,564 | A | * | 2/1989 | Hudson, Jr. | 123/184.42 |
| 4,821,685 | A | | 4/1989 | Matsushima et al. | |
| 4,901,681 | A | | 2/1990 | Pozniak et al. | |
| 5,003,932 | A | * | 4/1991 | Duncan | 123/184.34 |
| 5,400,750 | A | | 3/1995 | Jaeger et al. | |
| 5,575,249 | A | | 11/1996 | Mielke et al. | |
| 5,596,961 | A | * | 1/1997 | Faber | 123/184.38 |
| 5,711,261 | A | * | 1/1998 | Gambardella | 123/184.35 |
| 5,758,614 | A | | 6/1998 | Choi | |
| 5,899,197 | A | * | 5/1999 | Watanabe et al. | 123/572 |
| 6,055,726 | A | * | 5/2000 | Ito et al. | 29/888.04 |
| 6,089,199 | A | | 7/2000 | Lohr et al. | |
| 6,092,498 | A | | 7/2000 | Lohr et al. | |
| 6,095,105 | A | | 8/2000 | Lohr et al. | |
| 6,161,513 | A | | 12/2000 | Lohr et al. | |
| 6,199,530 | B1 | | 3/2001 | Brassell et al. | |
| 6,234,131 | B1 | | 5/2001 | Brassell et al. | |
| 6,467,449 | B2 | | 10/2002 | Brassell et al. | |
| 6,474,318 | B1 | | 11/2002 | Jones et al. | |
| 6,510,833 | B1 | | 1/2003 | Anthon | |
| 6,553,954 | B1 | * | 4/2003 | Slonecker | 123/184.38 |
| 6,561,169 | B2 | | 5/2003 | Sealy et al. | |
| 6,571,780 | B1 | | 6/2003 | Jones et al. | |
| 6,637,396 | B2 | | 10/2003 | Katayama | |
| 6,637,397 | B2 | | 10/2003 | Ward et al. | |
| 6,675,756 | B2 | | 1/2004 | Katayama | |
| 6,840,204 | B1 | * | 1/2005 | Brassell | 123/184.21 |

(Continued)

*Primary Examiner*—John T. Kwon
(74) *Attorney, Agent, or Firm*—Lanier Ford Shaver & Payn; Angela Holt; George P. Kobler

(57) ABSTRACT

An improved apparatus and method for intake air plenum construction for an automobile's internal combustion engine is claimed. The intake air plenum consists of an air inlet flange connected through a chamber to an air outlet flange. The intake air plenum improves upon conventional intake air plenums with a contoured interior chamber that eliminates restrictions and sharp turns. The method improves engine performance by optimizing air flow to the engine with an improved intake air plenum construction.

6 Claims, 10 Drawing Sheets

U.S. PATENT DOCUMENTS

| | | | | |
|---|---|---|---|---|
| 6,886,526 | B2 * | 5/2005 | Bishop | 123/198 E |
| 2002/0073971 | A1 * | 6/2002 | Katayama | 123/478 |
| 2002/0174847 | A1 | 11/2002 | Baumann et al. | |
| 2002/0179030 | A1 | 12/2002 | Fiesel et al. | |
| 2003/0010310 | A1 | 1/2003 | Pontoppidan | |
| 2003/0010321 | A1 | 1/2003 | Rentschler et al. | |
| 2003/0079707 | A1 | 5/2003 | Brassell et al. | |
| 2003/0116116 | A1 | 6/2003 | Anton | |
| 2003/0150433 | A1 | 8/2003 | Jones et al. | |
| 2003/0226535 | A1 | 12/2003 | Pietrowski et al. | |

* cited by examiner

INTAKE AIR PLENUM FOR INTERNAL COMBUSTION ENGINE

CROSS REFERENCE TO RELATED APPLICATIONS

This application is a continuation-in-part application which is based on and claims priority to U.S. Design patent application Ser. No. 29/198,261, filed on Jan. 27, 2004, now U.S. Pat. No. D, 512,074 which is incorporated by reference herein in its entirety.

BACKGROUND

1. Field

The present invention relates generally to an intake air plenum for an automobile's internal combustion engine for providing increased air flow to the intake manifold of an engine. More particularly, the present invention relates to an intake air plenum apparatus and method for providing an improved interior design that optimizes air flow through the plenum by utilizing an interior surface free from restrictions and sharp turns.

2. Background of the Invention

An intake air plenum is generally known in the field of automotive engine design as a chamber located between the throttle body and the lower manifold of an intake manifold that is used to distribute the intake charge evenly to the combustion chamber. Conventional and factory-installed intake air plenums generally include a sharp ninety (90) degree turn between the inlet air flange and the outlet air flange, so that air through the plenum is forced into a sharp turn that decreases air flow.

Automobile owners desiring to increase the horsepower of their engines may replace the conventional factory-installed plenum with the present invention, which overcomes the air-flow problems of the conventional plenum by providing a design optimized for maximum air flow to the engine.

SUMMARY OF THE INVENTION

The invention is directed to an apparatus and method for an improved intake air plenum for an automobile's internal combustion engine. The intake air plenum apparatus consists of a plenum body with an interior air flow chamber extending from an air inlet flange through a ninety-degree turn to an air outlet flange. In order to overcome the disruption to air flow that a sharp ninety degree turn would impose, the plenum body chamber has a curved interior surface with a raised roof and contoured floor that allow the interior cross-sectional area of the chamber to remain relatively uniform throughout the chamber. The intake air plenum method consists of providing improved air flow characteristics with an optimized intake air plenum design.

One embodiment of the present invention includes ports for vacuum lines and other fittings which number and placement vary depending upon the specific automobile engine configuration involved.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

These and other embodiments of the present invention will also become readily apparent to those skilled in the art from the following detailed description of the embodiments having reference to the attached figures, the invention not being limited to any particular embodiment(s) disclosed.

BRIEF DESCRIPTION OF THE DRAWINGS

The present invention is described with reference to the accompanying drawings. In the drawings, like reference numbers indicate identical or functionally similar elements.

DETAILED DESCRIPTION OF THE ILLUSTRATED EMBODIMENT

Figure 1:
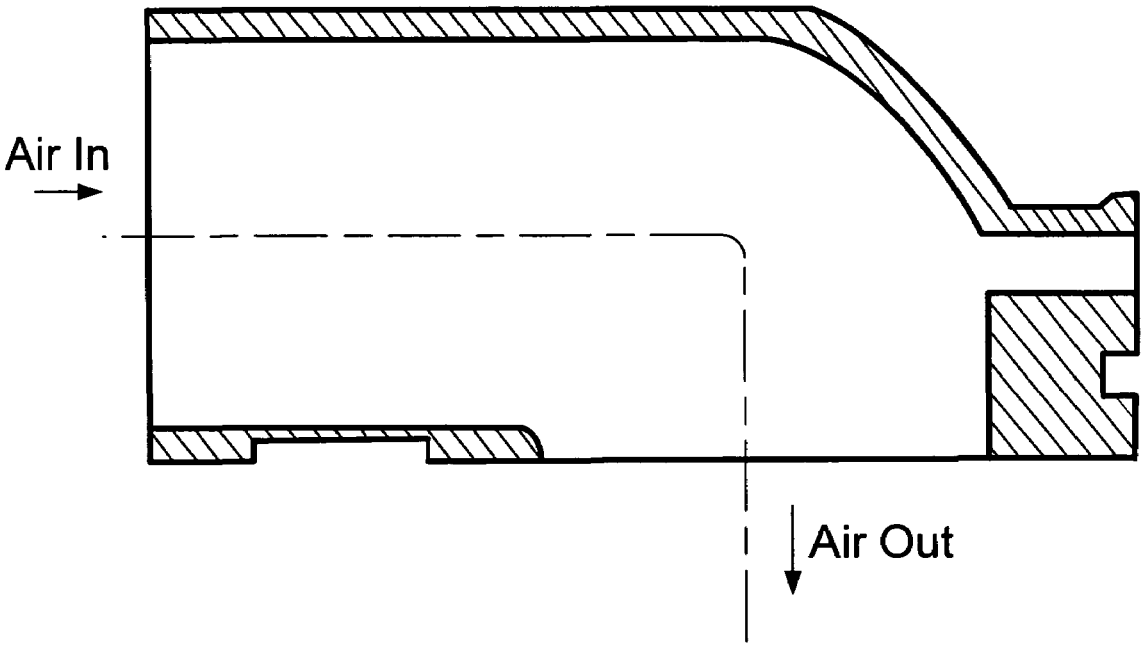
FIG. 1 (PRIOR ART)
FIG. 1 is a simplified cross section of a prior art conventional, factory-installed intake air plenum.

The present invention and its advantages are best understood by referring to the drawings. The elements of the drawings are not necessarily to scale, emphasis instead being placed upon clearly illustrating the principles of the invention. Throughout the drawings, like numerals are used for like and corresponding parts of the various drawings.

Figure 2:
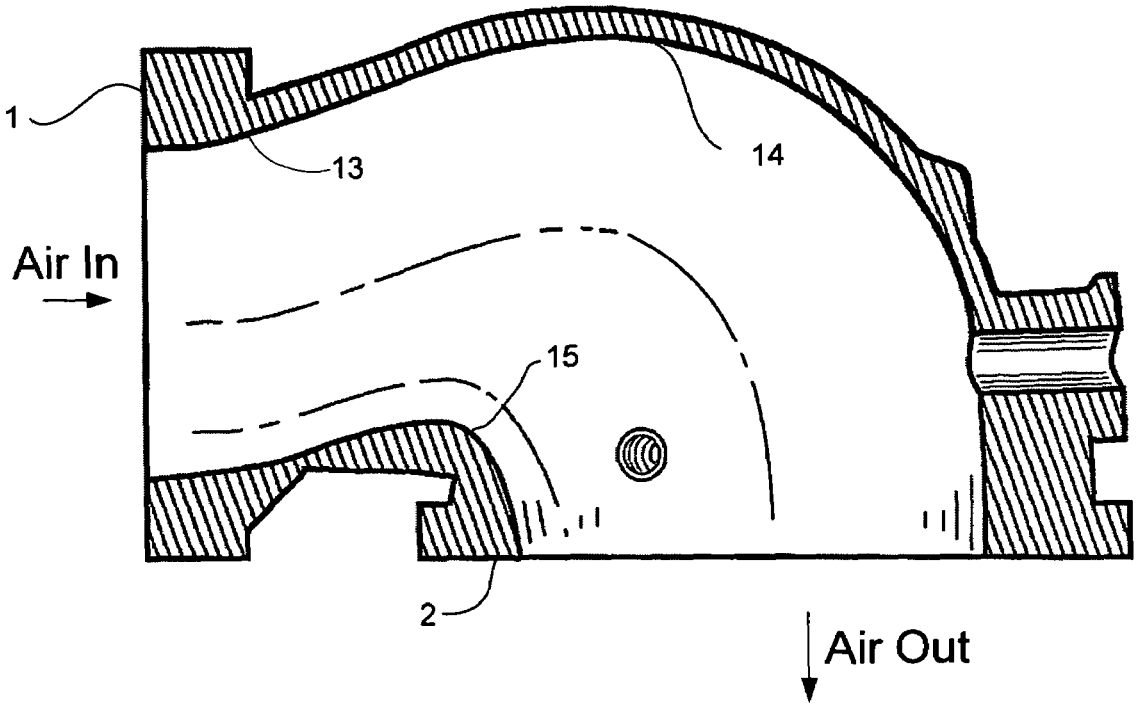
FIG. 2 is a simplified section of the embodiment of the invention shown in FIG. 3, taken along line 1—1 of FIG. 3.
Figure 3:
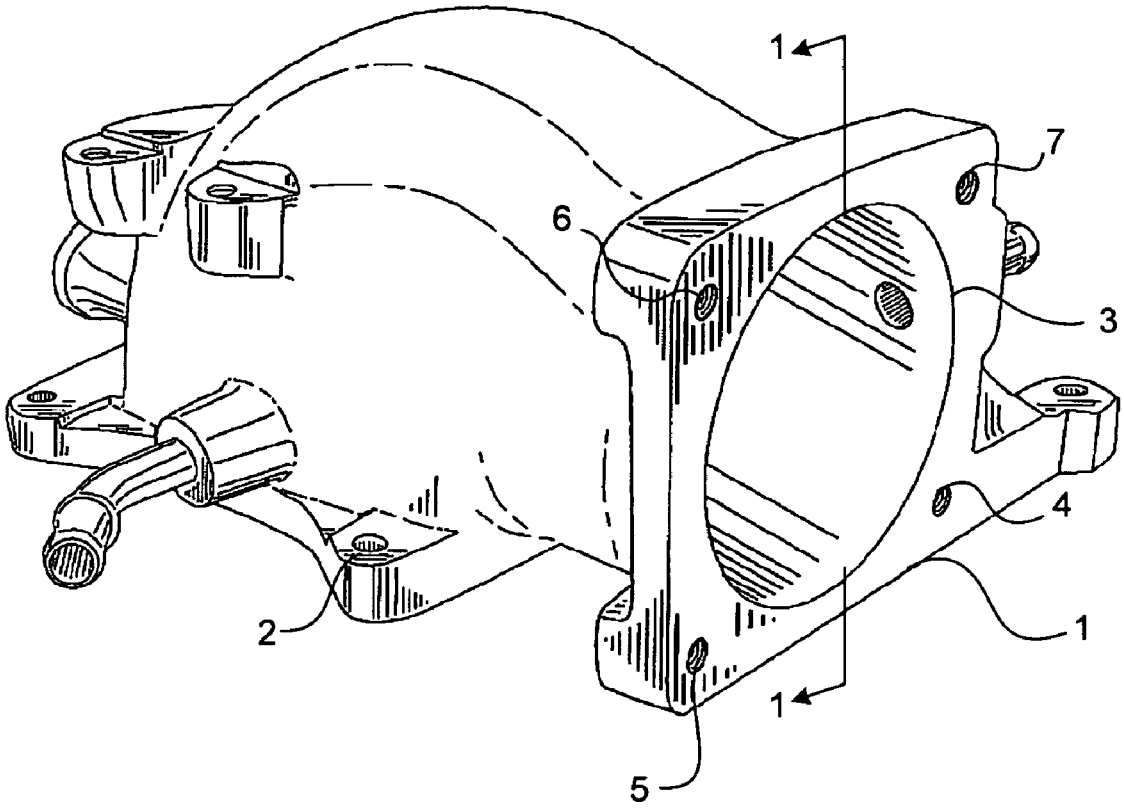
FIG. 3 is a perspective view of one embodiment of the invention.
Figure 4:
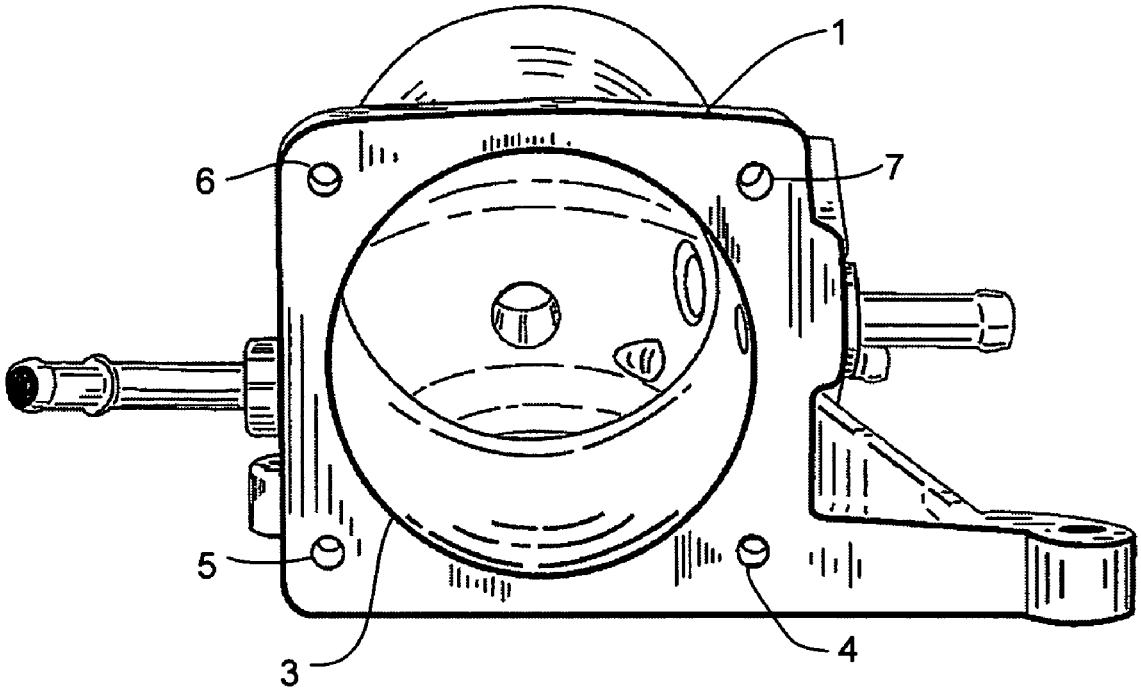
FIG. 4 is a front elevation view of the embodiment of the invention shown in FIG. 3.
Figure 5:
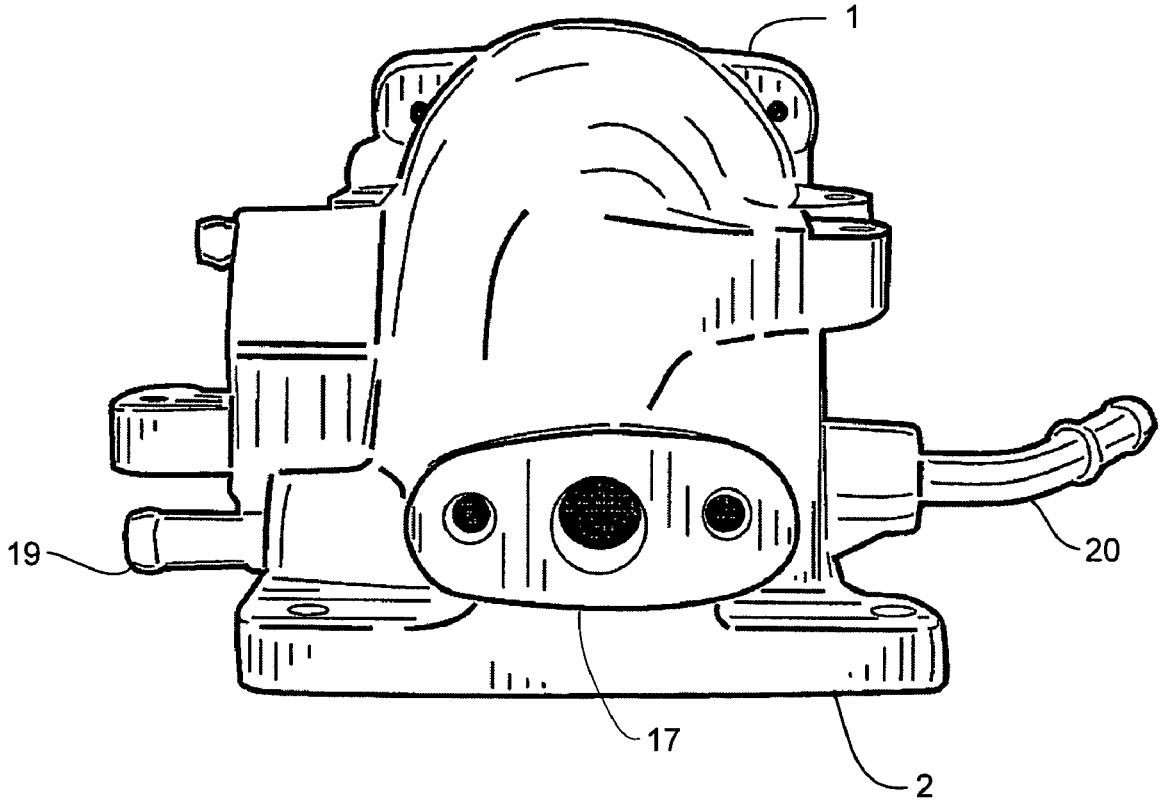
FIG. 5 is a rear elevation view of the embodiment of the invention shown in FIG. 3.
Figure 6:
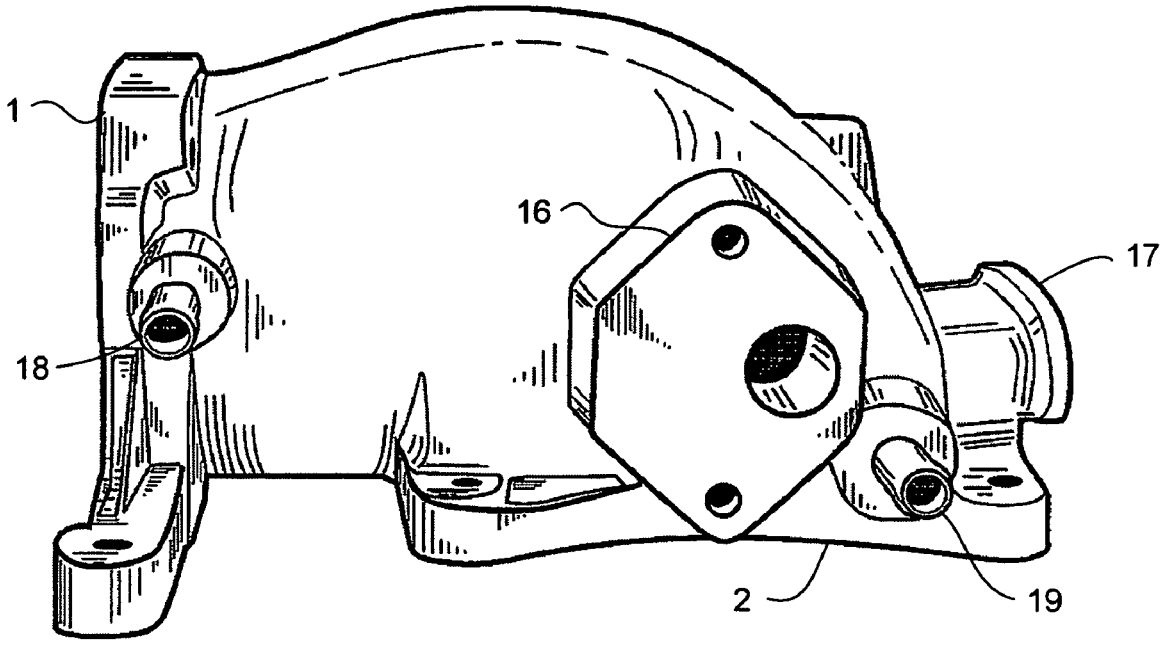
FIG. 6 is a right side elevation view of the embodiment of the invention shown in FIG. 3.
Figure 7:
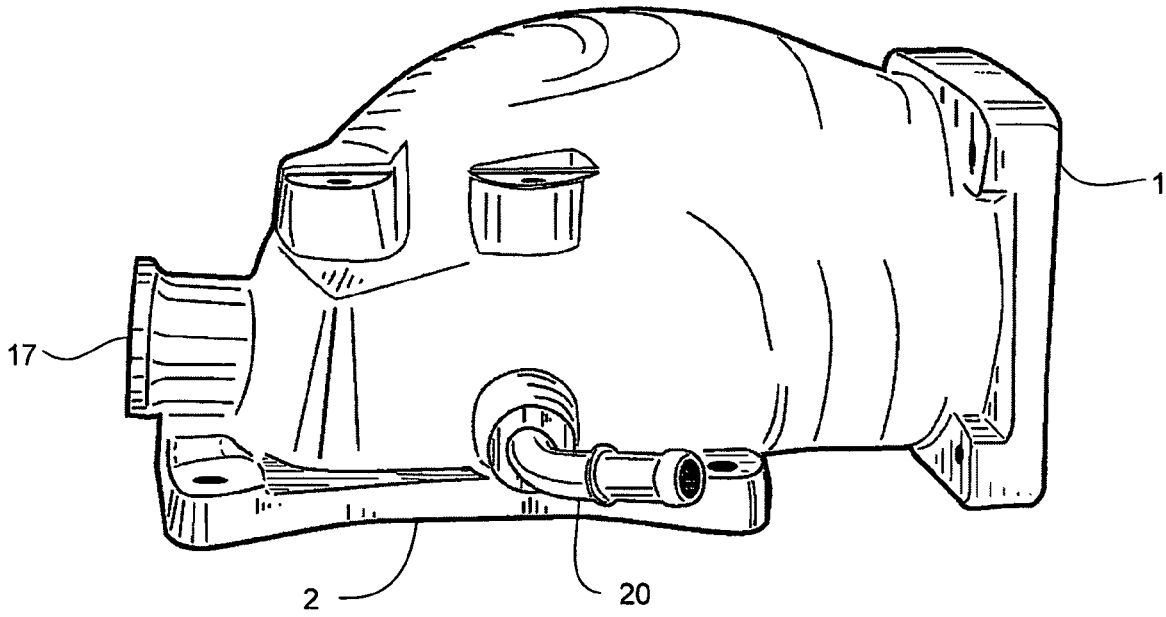
FIG. 7 is a left side elevation view of the embodiment of the invention shown in FIG. 3.
Figure 8:
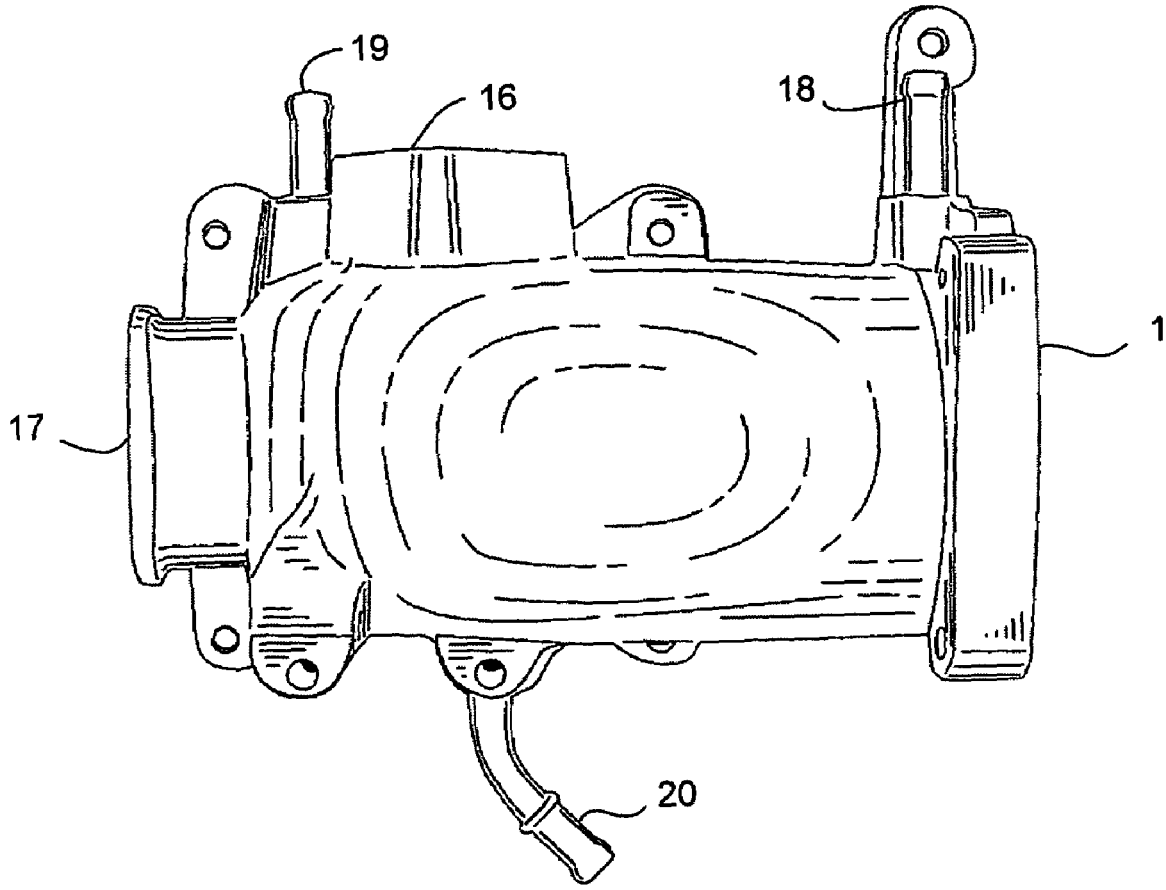
FIG. 8 is a top plan view of the embodiment of the invention shown in FIG. 3.

FIG. 1 illustrates for comparison purposes a cross-section of a conventional, factory-installed prior art intake air plenum. As is shown in FIG. 1, air entering the plenum horizontally is forced through a sharp ninety-degree turn in order to exit the plenum. This sharp turn decreases the air flow through the plenum and reduces the engine's performance. FIG. 2, an illustrative cross-section of the embodiment of the present invention shown in FIG. 3, illustrates the improvement of the present invention over the prior art. Referring to FIG. 2, the interior 13 of the intake air plenum chamber is contoured so that there are no restrictions or sharp turns. The roof of the interior chamber 14 is raised and the floor 15 of the interior chamber is curved so that the ninety-degree turn between the air inlet flange 1 and the air outlet flange 2 can be achieved without any significant decrease in the substantially circular cross sectional area of the chamber, though the chamber walls necessarily narrow as they transition to the air outlet flange 2, whose somewhat oval-shaped opening 8 (illustrated in FIG. 7) is dictated by the shape of the engine's factory-installed lower manifold air inlet. As would be appreciated by one of skill in the art of automobile engine design, the intake air plenum chamber maintains a substantially uniform and substantially circular cross-sectional area, and thus does not significantly restrict air flow into the lower manifold.

In another embodiment, the opening of the air inlet flange 1 is somewhat oval or oblong instead of circular, and in that embodiment the interior of the chamber maintains a somewhat oval or oblong cross-sectional shape with a substantially uniform cross-sectional area. In another embodiment, the lower intake manifold may be configured with a substantially circular inlet flange. The air outlet flange 2 may, therefore, describe a more circular opening 8, obviating the need to modify the shape of the interior 13 of the plenum.

FIG. 3 illustrates an exemplary embodiment of an intake plenum construction used as a replacement part on Ford Mustangs®, Ford Thunderbirds®, Ford Explorers®, Mercury Mountaineers and Ford Crown Victorias. The inventive plenum may be made of cast aluminium, though other metals and materials may be used, such as steel, ceramic, and durable, heat-resistant plastic. The air inlet flange 1 of this embodiment includes a generally circular opening 3 whose diameter is substantially the same as the outlet opening of the engine's throttle body, which is not part of the invention and is not illustrated. In other embodiments of the invention, the air inlet flange has an opening that is oval-shaped. Threaded holes 4–7, whose dimensions and location are dictated by the design of the outlet flange of the throttle body, facilitate connection of the air inlet flange to the throttle body. Although four holes (4–7) are illustrated, more or fewer may be desired depending upon the design of the throttle body outlet flange.

Figure 9:
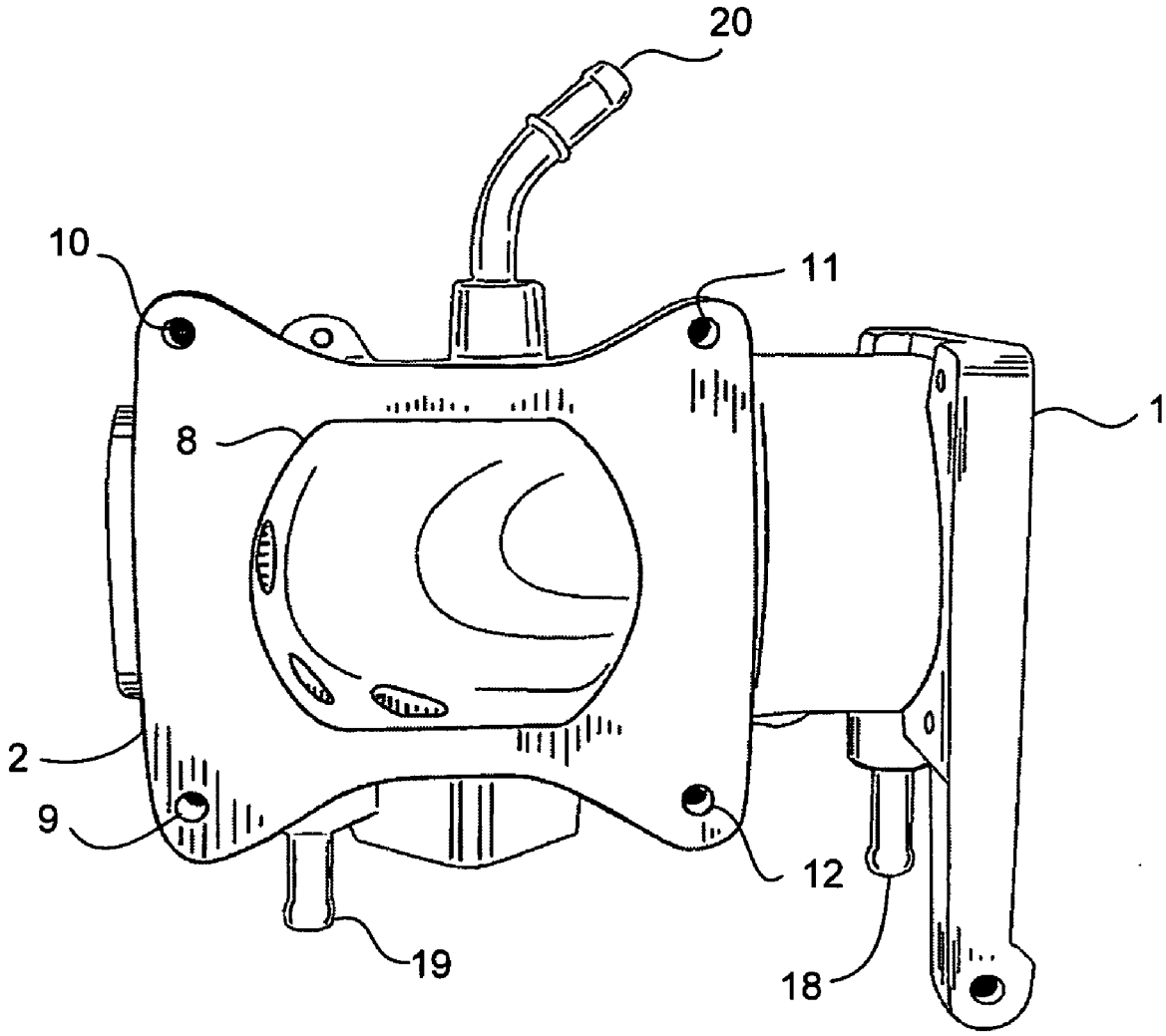
FIG. 9 is a bottom plan view of the embodiment of the invention shown in FIG. 3.

FIG. 9 illustrates the air outlet flange 2 of an exemplary embodiment of the invention, which includes a somewhat oval-shaped opening 8 whose dimensions are substantially the same as the inlet of the engine's lower manifold. Holes 9–12, whose dimensions and location are dictated by the inlet flange on the lower manifold, facilitate connection of the air outlet flange to the engine's lower manifold. Although four holes (9–12) are illustrated, more or fewer may be desired depending upon the design of the inlet flange of the engine's lower manifold.

Figure 10:
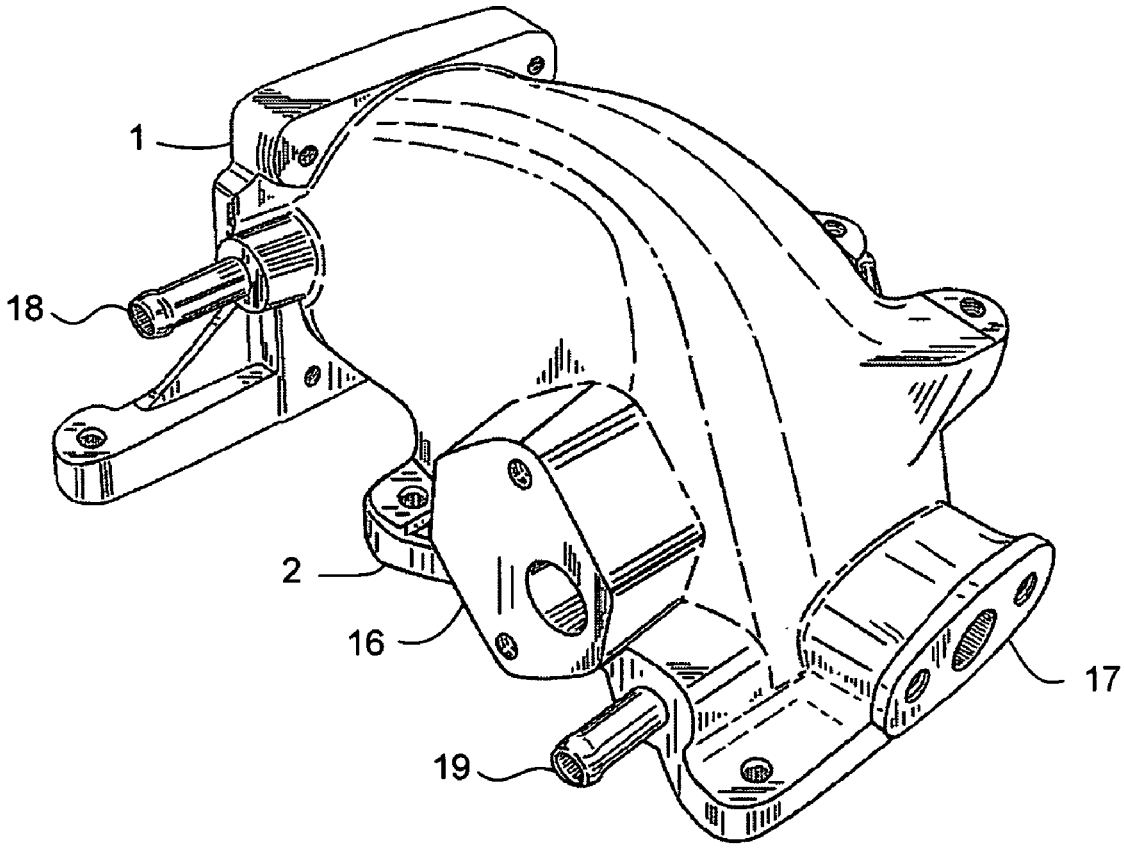
FIG. 10 is a rear perspective view of the embodiment of the invention shown in FIG. 3.

FIG. 10 illustrates flanges 16 and 17 which may be used in an embodiment to allow air into the manifold from other areas of the engine. FIG. 9 illustrates vacuum ports 18–20 which are used to provide a vacuum to other areas of the engine. The locations and dimensions of flanges 16 and 17 and vacuum ports 18–20 were dictated by the automobile engine design, and different configurations of flanges and vacuum ports may be necessary in different embodiments of the invention.

In the operation of the intake air plenum, air flow enters the plenum chamber through the substantially circular or somewhat oval-shaped opening of the air inlet flange 1 and then follows the contoured surfaces of the chamber in a smooth, curving turn before exiting the chamber at the air outlet flange 2. The absence of sharp turns or restrictions and the substantially uniform and substantially circular or somewhat oval-shaped cross-sectional area between the inlet and outlet flange in the chamber allow for more optimized air flow to the engine, and significantly reduce turbulent air flow.

This invention may be provided in other specific forms and embodiments without departing from the essential characteristics as described herein. The embodiment described is to be considered in all aspects as illustrative only and not restrictive in any manner. The following claims rather than the foregoing description indicate the scope of the invention.

As described above and shown in the associated drawings, the present invention comprises an intake air plenum. While particular embodiments of the invention have been described, it will be understood, however, that the invention is not limited thereto, since modifications may be made by those skilled in the art, particularly in light of the foregoing teachings. It is, therefore, contemplated by the appended claims to cover any such modifications that incorporate those features or those improvements that embody the spirit and scope of the present invention.

What is claimed is:

1. An intake air plenum for an automobile's internal combustion engine having a throttle body and a lower manifold comprising:

a plenum body defining a fluid flow chamber extending from an air inlet flange to an air outlet flange, wherein said plenum is installable between the engine's throttle body and lower manifold, and wherein said air inlet flange has an opening and is substantially perpendicular to said air outlet flange, and wherein said chamber has a curvilinear interior surface to allow for substantially smooth air flow from the air inlet flange to the air outlet flange, and wherein said chamber has a ceiling that is raised above the opening of the air inlet flange and a contoured floor.

2. The intake air plenum as recited in claim 1, wherein the interior cross-sectional area of the chamber is substantially uniform from the air inlet flange to the transition to the air outlet flange.

3. The intake air plenum as recited in claim 1, wherein said air inlet flange is connectable to the outlet of the engine's throttle body and said air outlet flange is connectable to the engine's lower manifold.

4. The intake air plenum as recited in claim 1, wherein said chamber includes a plurality of ports for connection to other parts of the engine.

5. The intake air plenum as recited in claim 1, wherein said plenum is made of cast aluminum.

6. The intake air plenum as recited in claim 1, wherein the interior cross-section of the chamber is substantially circular from the air inlet flange to the transition to the air outlet flange.

* * * * *

UNITED STATES PATENT AND TRADEMARK OFFICE

CERTIFICATE OF CORRECTION

PATENT NO. : 6,990,941 B1
APPLICATION NO. : 10/927213
DATED : January 31, 2006
INVENTOR(S) : Lee Frederick Bender It is certified that error appears in the above-identified patent and that said Letters Patent is hereby corrected as shown below:

On The Title Page The correct figure for the first page of the Patent is Figure 2, as was identified by the Applicant in the Application Data Sheet.

On The Title Page, Item (74) further, there is a typo in the name of the "Attorney, Agent, or Firm," which should read:

--LANIER FORD SHAVER & PAYNE; ANGELA HOLT; GEORGE P. KOBLER--

Signed and Sealed this

Nineteenth Day of June, 2007

JON W. DUDAS
*Director of the United States Patent and Trademark Office*